US006105905A

United States Patent [19]

Spence

[11] Patent Number: 6,105,905

[45] Date of Patent: Aug. 22, 2000

[54] RAILWAY GATE SYSTEM

[76] Inventor: Roy Spence, 2411 Church Ave., Brooklyn, N.Y. 11226

[21] Appl. No.: 09/236,416

[22] Filed: Jan. 25, 1999

[51] Int. Cl.[7] ..... B61L 1/00

[52] U.S. Cl. ..... 246/127; 246/261; 246/125; 246/292; 104/28; 104/30; 49/131; 49/25; 49/360

[58] Field of Search ..... 246/125, 126, 246/127, 260, 261, 272, 292, 293, 294, 295, 296, 304, 307, 313, 359; 104/27, 28, 30, 31; 49/25, 131, 360, 361

[56] References Cited

U.S. PATENT DOCUMENTS

| | | | |
|---|---|---|---|
| 1,259,060 | 3/1918 | West | 49/361 |
| 1,442,431 | 1/1923 | Hoffay | 104/30 |
| 1,531,118 | 3/1925 | McManus | 104/30 |
| 1,661,051 | 2/1928 | Siano | 246/127 |
| 4,922,655 | 5/1990 | Seal | 49/131 |
| 5,993,104 | 11/1999 | Marcotullio et al. | 249/127 |

*Primary Examiner*—Mark T. Le

[57] ABSTRACT

A railway gate system comprising a railway station having an elevated platform area for passengers to stand and a recessed area with a track and a train movable therealong. A gate has a continuous upper restraining rail along its length. A plurality of cylindrical posts each have an upper end secured to the lower surface of the rail and a lower end. A horizontal recess and vertical apertures are located in the edge of the platform area adjacent to the track. The recess is adapted to receive the rail when lowered to an inoperative orientation and with the circular apertures adapted to slidably receive the posts. Motion imparting mechanisms include elongated pistons having upper ends secured to the lower surface of the rail, central extents extending through selected spaced circular apertures in the platform and lower ends. Hollow cylinders are located beneath the selected spaced circular apertures having open upper ends to receive the pistons. The cylinders have lower ends with radial apertures therethrough for receiving motive power. A hydraulic power center contains a control mechanism. A pair of electric eyes located at spaced locations along the length of the track including a first eye to detect the approach of a car and a second eye to detect the departure of a car and to provide an actuation signal and inactuation signal to the control mechanisms to raise the pistons, posts and rail upon the approach of a car and to lower them upon passage of a car.

5 Claims, 4 Drawing Sheets

RAILWAY GATE SYSTEM

BACKGROUND OF THE INVENTION

1. Field of the Invention

The present invention relates to a Railway Gate System and more particularly pertains to increasing safety of railway passenger.

2. Description of the Prior Art

The use of railways of known designs and configurations is known in the prior art. More specifically, railways of known designs and configurations heretofore devised and utilized for the purpose of increasing the safety of railway systems through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,661,051 to Siano discloses a crossing safety device and operating mechanism therefor. U.S. Pat. No. 5,118,056 to Jeanise discloses a barricade apparatus. U.S. Pat. No. 4,942,395 to Ferrari et al discloses a railroad grade crossing motorist warning system. U.S. Pat. No. 1,929,859 to Strauss discloses photo-electric gell controls for highway barriers. U.S. Pat. No. 2,193,350 to Silver discloses a highway safety gate. Lastly, U.S. Pat. No. 2,403,014 to Nampa discloses an air operated auto-stop.

While these devices fulfill their respective, particular objectives and requirements, the aforementioned patents do not describe railway gate systems that allow increasing safety of railway passengers.

In this respect, the railway gate system according to the present invention substantially departs from the conventional concepts and designs of the prior art, and in doing so provides an apparatus primarily developed for the purpose of safety of railway passengers.

Therefore, it can be appreciated that there exists a continuing need for a new and improved railway gate system which can be used for increasing safety of railway passengers. In this regard, the present invention substantially fulfills this need.

SUMMARY OF THE INVENTION

In view of the foregoing disadvantages inherent in the known types of railways of known designs and configurations now present in the prior art, the present invention provides an improved railway gate system. As such, the general purpose of the present invention, which will be described subsequently in greater detail, is to provide a new and improved railway gate system and method which has all the advantages of the prior art and none of the disadvantages.

To attain this, the present invention essentially comprises a railway gate system. The railway station has an elevated platform area for passengers to stand in anticipation of entering a railway car. The railway station also has a recessed area. The recessed area has a track. The recessed area also has a car. The car is movable along the track for stopping at the station for loading and unloading passengers. Next provided is a gate. The gate has a continuous upper restraining rail along its length. The upper retraining rail is essentially equal to the length of the platform area. The upper retraining rail is positioned at the edge of the platform area in proximity to the track. Next provided are a plurality of cylindrical posts 34. Each post has an upper end secured to the lower surface of the rail. Each post also has a lower end. The lower end has spaced coupling bars interconnected to a set of a plurality of posts. A rectangular horizontal recess and circular vertical apertures are located in the edge of the platform area adjacent to the track. The recess is adapted to receive the rail when lowered to an inoperative orientation. The circular apertures are adapted to slidably receive the posts for movement between a raised operative orientation and a lowered inoperative orientation. Next provided are motion imparting mechanisms. The motion imparting mechanisms include elongated pistons. The elongated pistons have upper ends secured to the lower surface of the rail. The elongated pistons also have central extents extending through selected spaced circular apertures in the platform and lower ends. Hollow cylinders are located beneath the selected spaced circular apertures. The cylinders have open upper ends to receive the pistons. The cylinders also have lower ends with radial apertures therethrough for receiving motive power. A plurality of relay hoses couple the radial apertures of the cylinders. A hydraulic power center is coupled to the free end of one of the hoses. A control mechanism is operatively located within the power center. A pair of electric eyes are located at spaced locations along the length of the track. The electric eyes include a first eye which functions to detect the approach of a car. A second eye functions to detect the departure of a car. The first eye provides an actuation signal to the control mechanisms to raise the pistons, posts and rail upon the approach of a car. The second eye provides an inactuation signal to the control mechanisms to lower the pistons, posts and rail upon passage of a car. Lights are provided in the rail. The lights are adapted to be illuminated by the control mechanism upon the approach of a car. Lastly provided is a voice box. The voice box is located within the station and functions to provide a voice alarm upon the approach of a car.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved railway gate system which has all of the advantages of the prior art railways of known designs and configurations and none of the disadvantages.

It is another object of the present invention to provide a new and improved railway gate system which may be easily and efficiently manufactured and marketed.

It is further object of the present invention to provide a new and improved railway gate system which is of durable and reliable constructions.

An even further object of the present invention is to provide a new and improved railway gate system which is susceptible of a low cost of manufacture with regard to both materials and labor, and which accordingly is then susceptible of low prices of sale to the consuming public, thereby making such railway gate system economically available to the buying public.

Even still another object of the present invention is to provide railway gate systems for increasing railroad safety of passengers.

Lastly, it is an object of the present invention to provide a new and improved railway gate system comprising a railway station having an elevated platform area for passengers to stand and a recessed area with a track and a train movable therealong. A gate has a continuous upper restraining rail along its length and a plurality of cylindrical posts. A horizontal recess and vertical apertures are located in the edge of the platform area adjacent to the track. The recess is adapted to receive the rail when lowered to an inoperative orientation and with the circular apertures adapted to slidably receive the posts. Motion imparting mechanisms include elongated pistons. Hollow cylinders are located beneath the selected spaced circular apertures having open upper ends to receive the pistons. The cylinders have lower ends with radial apertures therethrough for receiving motive power. A hydraulic power center contains a control mechanism. A pair of electric eyes located at spaced locations along the length of the track include a first eye to detect the approach of a car and a second eye to detect the departure of a car and to provide an actuation signal and inactuation signal to the control mechanisms to raise the pistons, posts and rail upon the approach of a car and to lower them upon passage of a car.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
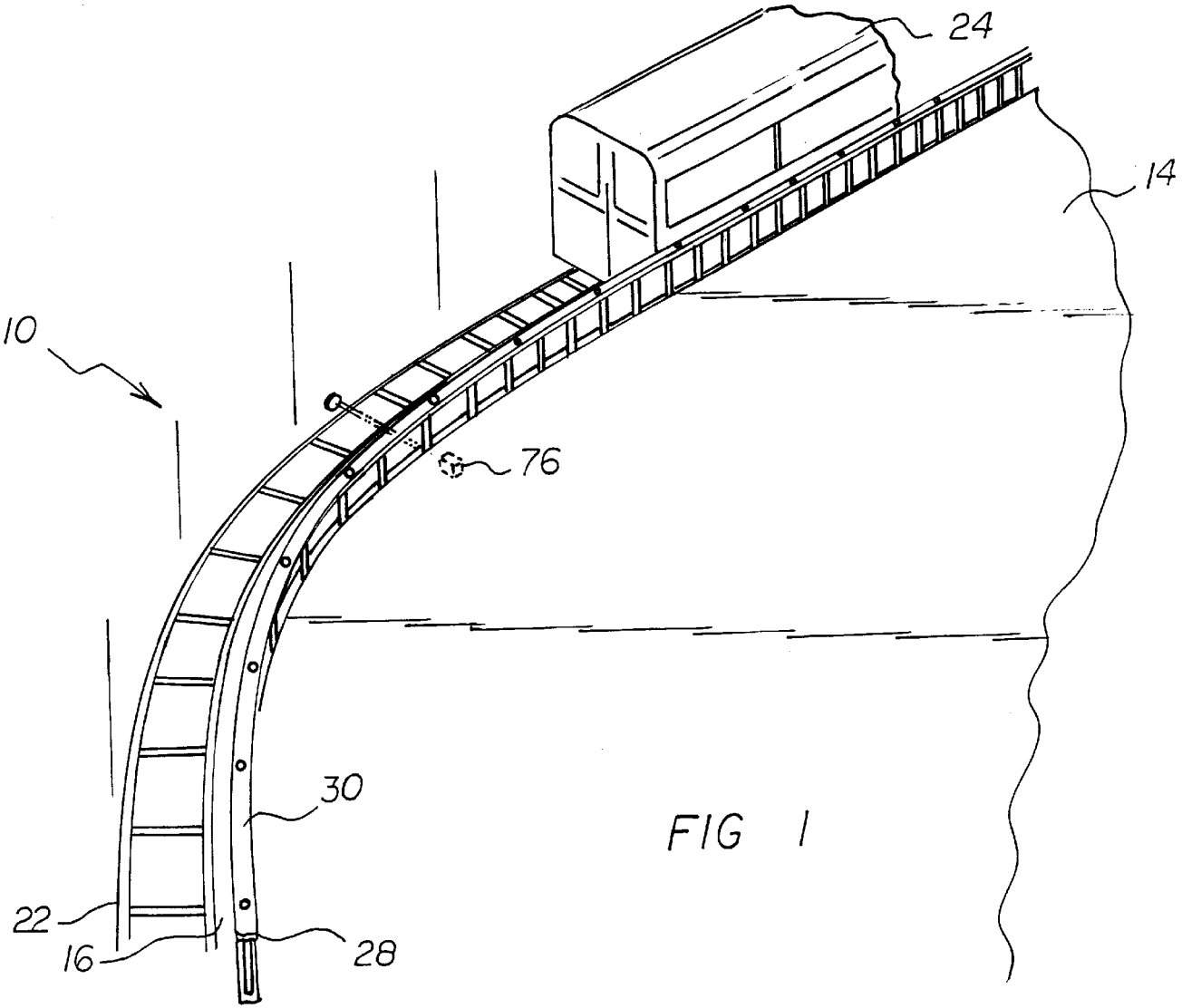
FIG. 1 is a perspective illustration of the new and improved railway gate system constructed in accordance with the principles of the present invention.
Figures 2, 3:
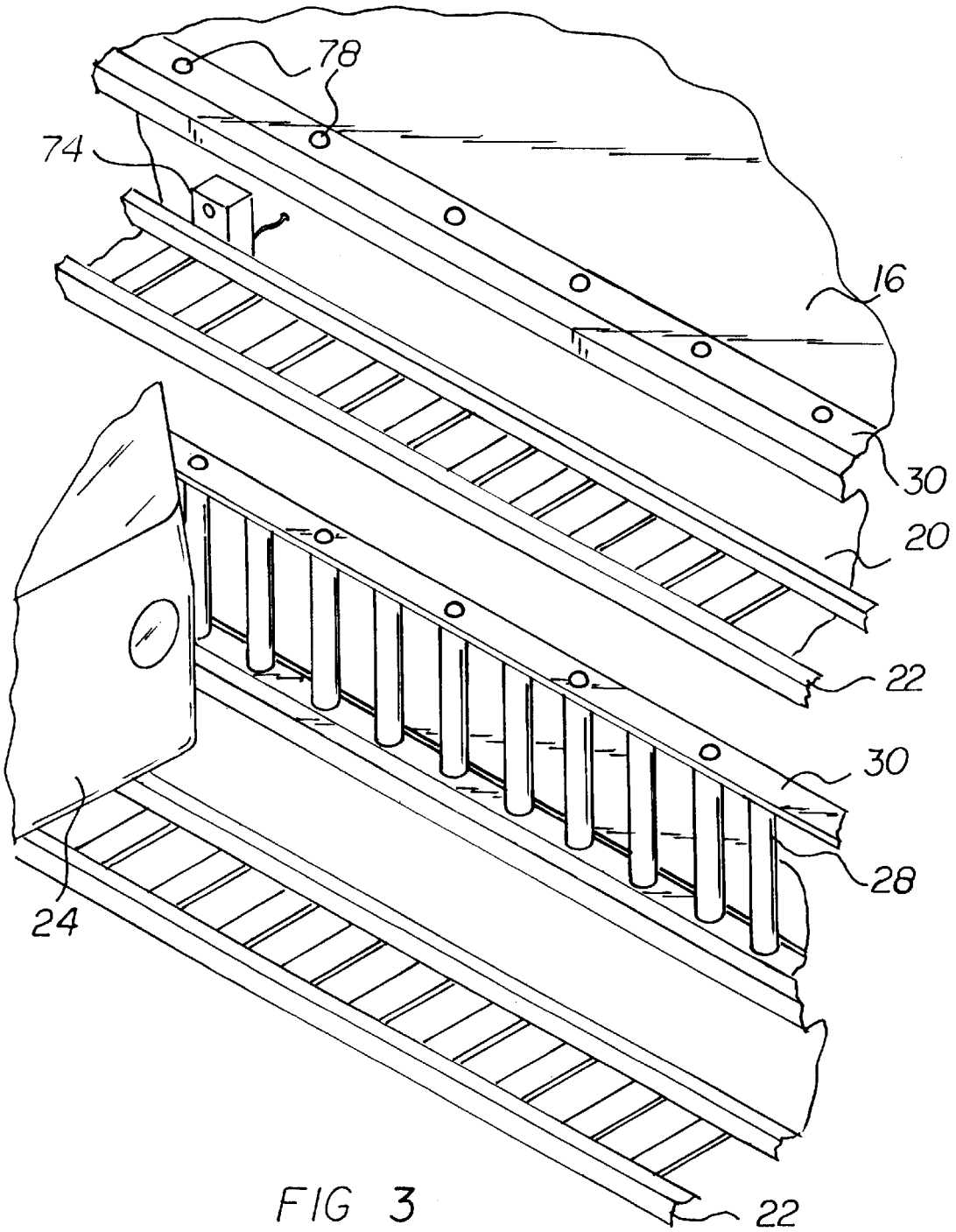
FIG. 2 an enlarged perspective view of the system shown adjacent to the end of the platform.
FIG. 3 is a perspective showing similar to FIG. 2, but with the gate raised.
Figure 4:
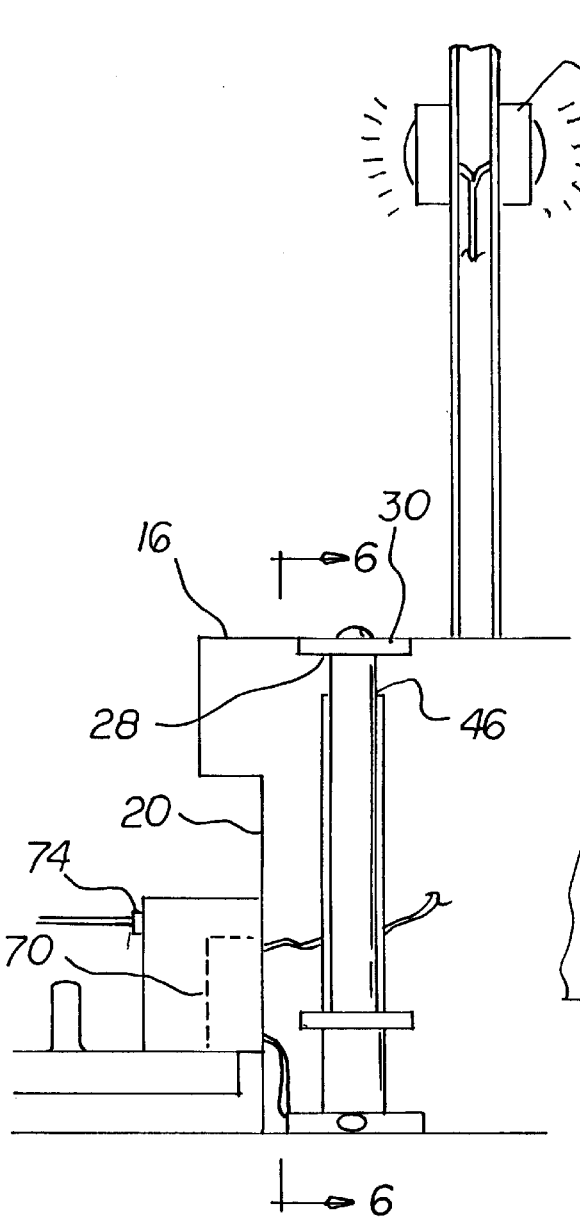
FIG. 4 is an end elevational view of the system shown in the prior Figures.
Figure 5:
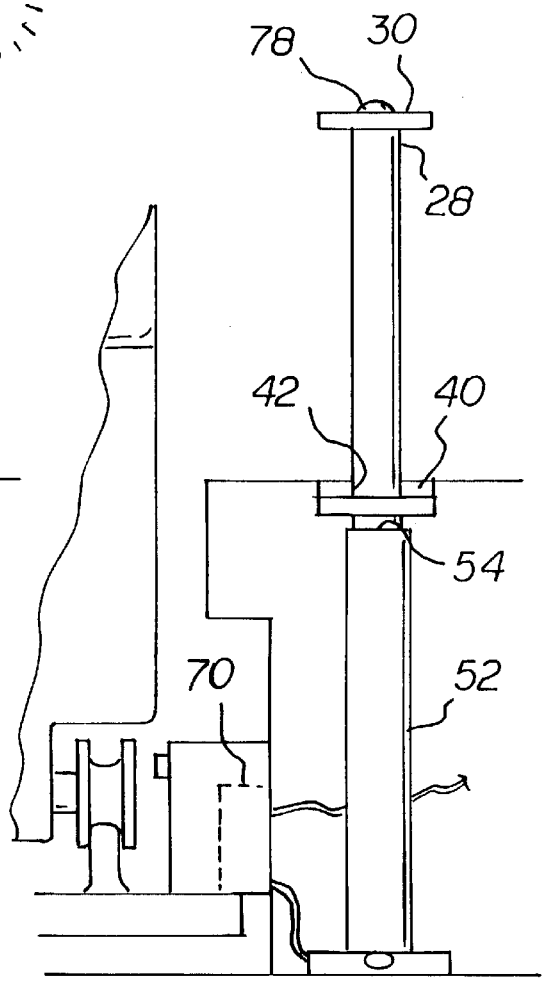
FIG. 5 is a view similar to FIG. 4 but with the gate raised.
Figure 6:
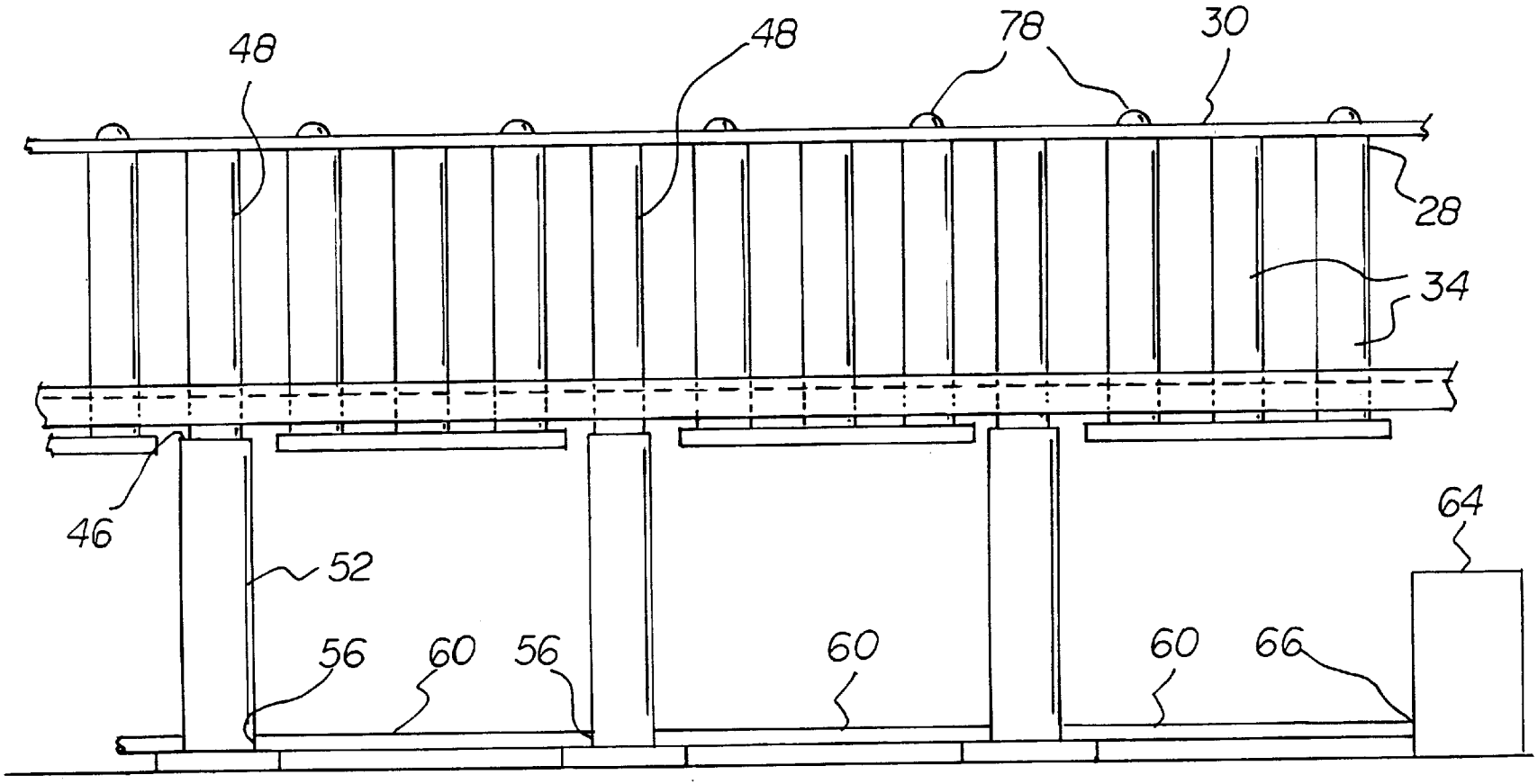
FIG. 6 is a cross-sectional view taken along Line 6—6 of FIG. 4.

With reference now to the drawings, and in particular to FIG. 1 thereof, the preferred embodiment of the new and improved railway gate system embodying the principles and concepts of the present invention and generally designated by the reference numeral 10 will be described.

The present invention, the railway gate system 10 is comprised of a plurality of components. Such components in their broadest context include a railway station, a gate, a plurality of cylindrical posts, a horizontal recess and vertical apertures, motion imparting mechanisms, hollow cylinders, a hydraulic power center, a control mechanism, and a pair of electric eyes. Such components are individually configured and correlated with respect to each other so as to attain the desired objective.

First provided is a railway station 14. The railway station has an elevated platform area 16 for passengers to stand in anticipation of entering a railway car. The railway station also has a recessed area 20. The recessed area has a track 22. The recessed area also has a car 24. The car is movable along the track for stopping at the station for loading and unloading passengers.

Next provided is a gate 28. The gate has a continuous upper restraining rail 30 along its length. The upper retraining rail is essentially equal to the length of the platform area. The upper retraining rail is positioned at the edge of the platform area in proximity to the track.

Next provided are a plurality of cylindrical posts 34. Each post has an upper end secured to the lower surface of the rail. Each post also has a lower end. The lower end has spaced coupling bars 36 interconnected to a set of a plurality of posts. A rectangular horizontal recess 40 and circular vertical apertures 42 are located in the edge of the platform area adjacent to the track. The recess is adapted to receive the rail when lowered to an inoperative orientation. The circular apertures are adapted to slidably receive the posts for movement between a raised operative orientation and a lowered inoperative orientation.

Next provided are motion imparting mechanisms 46. The motion imparting mechanisms include elongated pistons 48. The elongated pistons have upper ends secured to the lower surface of the rail. The elongated pistons also have central extents extending through selected spaced circular apertures in the platform and lower ends.

Hollow cylinders 52 are located beneath the selected spaced circular apertures. The cylinders have open upper ends 54 to receive the pistons. The cylinders also have lower ends with radial apertures 56 therethrough for receiving motive power.

A plurality of relay hoses 60 couple the radial apertures of the cylinders. A hydraulic power center 64 is coupled to the free end 66 of one of the hoses. A control mechanism 70 is operatively located within the power center.

A pair of electric eyes are located at spaced locations along the length of the track. The electric eyes include a first eye 74 which functions to detect the approach of a car. A second eye 76 functions to detect the departure of a car. The first eye provides an actuation signal to the control mechanisms to raise the pistons, posts and rail upon the approach of a car. The second eye provides an inactuation signal to the control mechanisms to lower the pistons, posts and rail upon passage of a car.

Lights 78 are provided in the rail. The lights are adapted to be illuminated by the control mechanism upon the approach of a car.

Lastly provided is a voice box 82. The voice box is located within the station and functions to provide a voice alarm upon the approach of a car.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved gate system for railroad safety comprising, in combination:

a railway station having an elevated platform area for passengers to stand in anticipation of entering a railway car and a recessed area with a track and a car movable along the track for stopping at the station for loading and unloading passengers;

a gate having a continuous upper restraining rail along its length essentially equal to a length of the platform area and positioned at an edge of the platform area in proximity to the track;

a plurality of cylindrical posts each having an upper end secured to a lower surface of the rail and a lower end with spaced coupling bars interconnected to a set of a plurality of paid posts;

a rectangular horizontal recess and circular vertical apertures located in the edge of the platform area adjacent to the track, the recess adapted to receive the rail when lowered to an inoperative orientation and with the circular apertures adapted to slidably receive the posts for movement between a raised operative orientation and a lowered inoperative orientation;

motion imparting mechanisms including elongated pistons having upper ends secured to the lower surface of the rail, central extents extending through selected spaced circular apertures in the platform area and lower ends;

hollow cylinders located beneath the selected spaced circular apertures having open upper ends to receive the pistons, the cylinders having lower ends with radial apertures therethrough for receiving motive power;

a plurality of relay hoses coupling the radial apertures of the cylinders;

a hydraulic power center coupled to the free end of one of the hoses;

a control mechanism operative located within the power center;

a pair of electric eyes located at spaced locations along the length of the track including a first eye to detect the approach of a car and a second eye to detect the departure of a car and to provide an actuation signal and inactuation signal to the control mechanism to raise the pistons, posts and rail upon the approach of a car and to lower them upon passage of a car;

lights in the rail adapted to be illuminated by the control mechanism upon the approach of a car; and a voice box located within the station to provide a voice alarm upon the approach of a car.

2. A railway gate system comprising:

a railway station having an elevated platform area for passengers to stand and a recessed area with a track and a train movable along the track;

a gate having a continuous upper restraining rail along its length;

a plurality of cylindrical posts each having an upper end secured to a lower surface of the rail and a lower end;

a horizontal recess and vertical apertures located in an edge of the platform area adjacent to the track, the recess adapted to receive the rail when lowered to an inoperative orientation and with the circular apertures adapted to slidably receive the posts;

motion imparting mechanisms including elongated pistons having upper ends secured to the lower surface of the rail, central extents extending through selected spaced circular apertures in the platform area and lower ends;

hollow cylinders located beneath the selected spaced circular apertures having open upper ends to receive the pistons, the cylinders having lower ends with radial apertures therethrough for receiving motive power;

a hydraulic power center;

a control mechanism within the power center; and a pair of electric eyes located at spaced locations along the length of the track including a first eye to detect the approach of a car and a second eye to detect the departure of a car and to provide an actuation signal and inactuation signal to the control mechanism to raise the pistons, posts and rail upon the approach of a car and to lower them upon passage of a car.

3. The system as set forth in claim 2 and further including a plurality of relay hoses coupled to the cylinders for providing motive power to the pistons.

4. The system as set forth in claim 2 and further including lights on the rail adapted to be illuminated by the control mechanism upon the approach of a car.

5. The system as set forth in claim 2 and further including a voice box located within the station to provide a voice alarm upon the approach of a car.

* * * * *